United States Patent [19]

Näpflin

[11] 4,410,200

[45] Oct. 18, 1983

[54] SKI BINDING WITH STEP FRAME AND RETRACTION INSTALLATION

[76] Inventor: Hans Näpflin, Kastanienalle 5, 6375 Beckenried, Switzerland

[21] Appl. No.: 299,542

[22] Filed: Sep. 4, 1981

[30] Foreign Application Priority Data

Sep. 8, 1980 [AT] Austria ..... 4509/80

[51] Int. Cl.[3] ..... A63C 9/083; A63C 9/16

[52] U.S. Cl. ..... 280/618; 280/614; 280/615; 280/617

[58] Field of Search ..... 280/611, 614, 615, 617, 280/618, 620, 637

[56] References Cited

U.S. PATENT DOCUMENTS

| | | | |
|---|---|---|---|
| 4,003,587 | 1/1977 | Salomon | 280/618 |
| 4,128,257 | 12/1978 | Zoor | 280/618 |
| 4,188,045 | 2/1980 | Marker | 280/618 |
| 4,273,355 | 6/1981 | Storandt | 280/618 |

*Primary Examiner*—Joseph F. Peters, Jr.

*Assistant Examiner*—Pierre Huggins

*Attorney, Agent, or Firm*—Lee, Smith & Jager

[57] ABSTRACT

A ski binding having a sole plate which is mounted on a ski and including a step frame which can swivel about an axis on the front side of the sole plate. The sole plate is connected in a releasable manner to the ski so that if a skier falls, he is released from the ski. The step frame can be solidly connected to the sole plate during a downhill run but can be released to facilitate cross-country skiing. A draw spring, one end of which is connected to the under side of the sole plate, has its other end connected to a strap which passes through an opening in the upper side of the sole plate. A buckle is attached to the strap where it passes through the sole plate. When the buckle is situated on the sole plate, the step frame can swivel freely about its connection axis. On the other hand, when the buckle is located on the step frame, the spring tension tends to maintain the step frame against the sole plate.

3 Claims, 3 Drawing Figures

SKI BINDING WITH STEP FRAME AND RETRACTION INSTALLATION

BACKGROUND OF THE INVENTION

The invention concerns itself with a ski binding with a sole plate having a step frame which carries the binding part for a ski boot and whose front end has been in hinged in a swivel manner.

STATE OF THE ART

Ski bindings of the above-mentioned type are used by skiers who practice cross-country, during which they must cover long stretches and frequently climb. The step frame, which has been connected with the sole plate in a swivel manner, facilitiates running and climbing as the rigid ski boot has been connected to the ski in a swivel manner. During a steep climb it is advantageous and pleasurable when the ski does not hang in a loose swivel manner on the boot but rather is connected to it in a spring-elastic manner.

To attain this result, one binding of the prior art has installed a retraction installation, a so-called "returner." At the start, the step frame is rigidly connected to the sole plate.

DE-AS 28 46 914 shows such a retraction installation in which the step frame is held onto the sole plate by means of two draw springs that are led sideways along the outside of the ski boot. In the front area springs are attached to the sole plate and on the other end they are connected with each other by means of a cable. By means of a tightener, it holds the boot onto the step frame. At the start, the cable is pushed under the side protrusions of the sole plate and then connects the step frame with the sole plate. The side installed springs of this installation are unprotected and are easily damaged and then can no longer hold the ski boot. Thus it is not possible to eliminate the effect of the springs during running as, indeed, they hold the ski boot onto the step frame. When running in fresh snow this is a disadvantage.

SUMMARY OF THE INVENTION

It is the object of the invention to provide a retraction installation with a large sized spring which is protected against damage and which can tolerate the load on an endurance run. During sharp turns or when removing the ski it should hold the latter rigidly onto the ski boot. It contributes noticeably also during running (gliding) in pushing the ski forwards. On the other hand, when running in fresh snow, the effect of the installation can be omitted.

The invention solution is characterized by a retraction installation in which the draw spring is installed in a recess in the under side of the sole plate and at which the other end of the draw spring is connected with a strap which is led through an opening through the sole plate and which can be connected with the step frame.

It is an advantage to include a bearing plate on the front end of the step frame and a buckle on the front end of the strap which through optional tilting can lay against either the bearing plate or the sole plate. In this manner, the effect of the retraction installation can be omitted.

BRIEF DESCRIPTION OF THE DRAWING

In the enclosed drawing there is illustrated a representative embodiment of the invention.

DESCRIPTION OF THE REPRESENTATIVE EMBODIMENT

Figure 1:
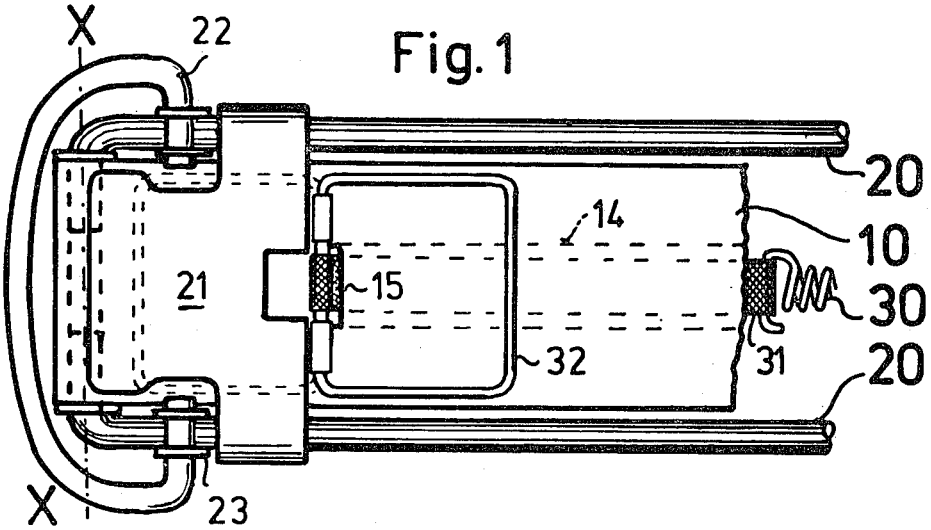
FIG. 1 shows a portion of a ski binding with a sole plate with a step frame and a retraction installation in a top view.
Figure 2:
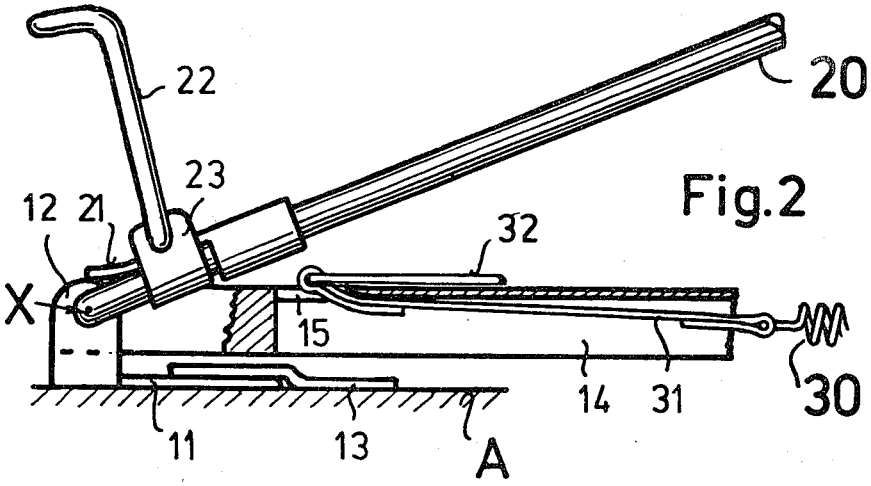
FIG. 2 shows a side view of the same ski binding, partially in section, with a lifted step frame and a disconnected retraction installation.

Of the sole plate 10 only the front part has been shown. A step frame 20 has been hinged completely at the front to the sole plate 10. The step frame 20 consists, in essence, of a U-shaped bent iron rod frame. On the front of the step frame has been installed the bearing plate 21 which holds the ends of the frame together. In this area there has also been installed a retention buckle 22 which can be used to attach a ski boot (not illustrated) onto the step frame 20. The retention buckle 22 is connected in a swivel manner to the step frame by means of two U-shaped brackets 23.

A retention plate 11 is connected in a swivel manner to the sole plate 10 by means of two ears 12 that stick out on both sides of the sole plate. A second Z-shaped bracket 13 which is placed on the ski A fixes the sole plate 10 in a sideways swivel manner on the ski A.

The backside of the sole plate 10 (not illustrated) is connected in a releaseable manner with the ski by means of a known and therefore not represented retention installation.

Under the relatively thick sole plate 10 there is made a recess 14 in which is located a draw spring 30. On its back side (not shown) the draw spring 30 is fixed onto the sole plate. On the front side it is suspended on a strap 31. The pulling strap 31 leads through an opening 15 to the upper side of the sole plate 10. On the front end of the pulling strap 31 is suspended a buckle 32 which is wider than the opening 15 and thus forms a stop for the draw spring 30 which remains under tension. The lower, backside edge of the opening 15 is rounded at 16 so that the strap slides along the rounded edge when it is pulled out of the opening.

DOWNHILL AND RUNNING WITH THE STEP FRAME

In a downhill run, the step frame 20 can be fixed onto the sole plate 10 by means of a retention installation, not represented in the drawing, which grips onto the backside of the step frame 20.

Through the step frame, the ski boot is then solidly connected to the sole plate and the latter is in turn connected in a releaseable manner to the ski. During excess stress when the skier falls, the sole plate is released from the ski.

Figure 3:
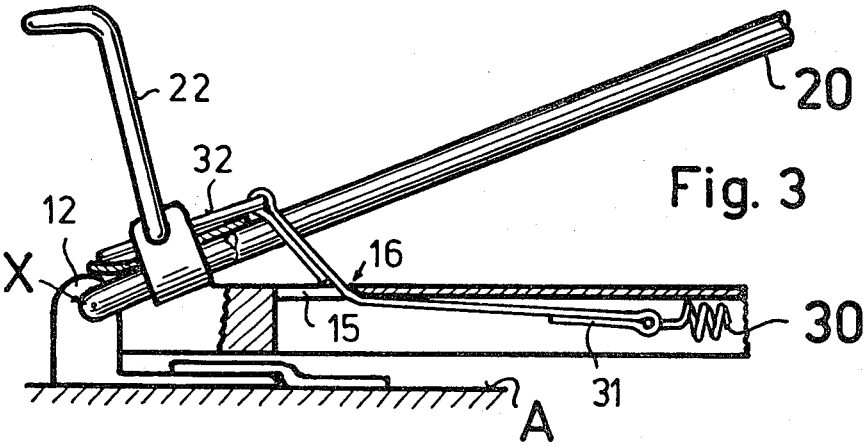
FIG. 3 is a side view, similar to FIG. 2, with an operative retraction installation.

When running or climbing, one releases the step frame for the backside retention installation. Thus, the step frame and the connected ski boot can swivel around the axis x—x which substantially facilitates running with a rigid ski boot. Additionally, according to desire, one can also make use of the retraction installation 30–32. When the buckle 32 is located on top of the sole plate 10, the retraction installation is not operative. When, as is represented in FIG. 3, the buckle 32 has been tilted forward onto the bearing plate 21, then the spring 30 tends to pull the step frame 20 back onto the sole plate 10 and thus produces a better contact between the boot and the ski. In this mode, the buckle 32 is clamped between the underside of the sole of the ski boot and the bearing plate 21.

What is claimed is:

1. Ski binding including a sole plate having a front end and a step frame hinged to said front end in a swivel manner, the step frame including means for securing a ski boot to the step frame and having a retraction installation for urging the step frame against the sole plate, said retraction installation having at least one draw spring connected at one end to the sole plate, which is characterized by a recess (14) located in the underside of the sole plate (10) and an opening (15) in the sole plate (10), said draw spring (30) being positioned in the recess (14) and the other end of the draw spring (30) being connected to a strap (31) which passes through the opening (15) and which is attached to a buckle (32), and further including a bearing plate (21) attached to the front end of the step frame (20), said buckle (32) being pivotable into one of two orientations, a first orientation in which said buckle (32) lays upon the sole plate (10), and a second orientation in which said buckle lays upon the bearing plate (21).

2. Ski binding in accordance with claim 1 in which said buckle (32) includes means to maintain the draw spring (30) under tension.

3. Ski binding in accordance with claim 2 in which said means to maintain comprises the width of said buckle (32) being wider than the width of the opening (15) such that said buckle (32) cannot pass through the opening (15).

* * * * *